US008998012B2

(12) United States Patent
Bailey et al.

(10) Patent No.: US 8,998,012 B2
(45) Date of Patent: Apr. 7, 2015

(54) CONTAINER CAP LOCKING MECHANISM

(75) Inventors: Jeffrey Bailey, Grandview, MO (US); Dale Sass, Gardner, KS (US)

(73) Assignee: Integrity Products, Inc., Grandview, MO (US)

( * ) Notice: Subject to any disclaimer, the term of this patent is extended or adjusted under 35 U.S.C. 154(b) by 335 days.

(21) Appl. No.: 12/697,094

(22) Filed: Jan. 29, 2010

(65) Prior Publication Data

US 2011/0031734 A1 Feb. 10, 2011

Related U.S. Application Data

(60) Provisional application No. 61/148,294, filed on Jan. 29, 2009.

(51) Int. Cl.
*B65D 50/04* (2006.01)
*B65D 41/04* (2006.01)

(52) U.S. Cl.
CPC ..... *B65D 41/0471* (2013.01)

(58) Field of Classification Search
CPC .... B65D 50/046; B65D 50/048; B65D 50/04; B65D 50/043
USPC ..... 215/216, 321, 329, 330, 331, 335, 336, 215/43, 201, 280, 218, 273, 277; 220/288, 220/789
See application file for complete search history.

(56) References Cited

U.S. PATENT DOCUMENTS 2,106,313 A * 1/1938 Amrine ..... 401/128
2,175,735 A * 10/1939 Banks ..... 401/119
3,216,600 A * 11/1965 Dreps ..... 215/230
3,339,770 A * 9/1967 Weigand ..... 215/214
3,841,514 A * 10/1974 Montgomery et al. ..... 215/216
3,913,769 A 10/1975 Scrocco et al.
4,091,948 A * 5/1978 Northup ..... 215/222
4,144,983 A * 3/1979 Pauls et al. ..... 215/216
4,335,823 A * 6/1982 Montgomery et al. ..... 215/206
4,375,858 A * 3/1983 Shah et al. ..... 215/217
4,519,518 A * 5/1985 Wiles et al. ..... 215/331
4,630,743 A * 12/1986 Wright ..... 215/216
4,646,926 A 3/1987 Agbay et al.
5,082,129 A * 1/1992 Kramer ..... 215/221
5,449,078 A * 9/1995 Akers ..... 215/222
5,460,281 A * 10/1995 Rapchak et al. ..... 215/216
5,586,676 A * 12/1996 Lynd ..... 220/212
5,603,421 A * 2/1997 Opresco ..... 215/217
5,853,093 A * 12/1998 Neiger ..... 215/237
5,988,412 A * 11/1999 Minnette et al. ..... 215/216
6,003,700 A * 12/1999 Julian et al. ..... 215/216
6,168,035 B1 * 1/2001 McLelland ..... 215/216
6,279,766 B1 * 8/2001 Jones et al. ..... 215/219

(Continued)

FOREIGN PATENT DOCUMENTS

EP 146237 A1 * 6/1985 ..... B65D 41/34
EP 365136 A1 * 4/1990 ..... B65D 41/34
GB 2185244 A * 7/1987 ..... B65D 55/02

*Primary Examiner* — Fenn Mathew
*Assistant Examiner* — Chetan Chandra
(74) *Attorney, Agent, or Firm* — Bradley IP, LLC; Sean T. Bradley

(57) ABSTRACT

A container cap locking mechanism includes a barb and adjacent stop both projecting downward from a cap edge to mesh with a V-shaped block projecting outward from a container sidewall.

11 Claims, 8 Drawing Sheets

(56) References Cited

U.S. PATENT DOCUMENTS

| | | | | |
|---|---|---|---|---|
| 6,446,823 | B2 * | 9/2002 | Miceli et al. | 215/228 |
| 6,871,752 | B2 * | 3/2005 | Montgomery | 215/219 |
| 7,165,692 | B2 * | 1/2007 | Konefal et al. | 215/220 |
| 7,331,479 | B2 * | 2/2008 | Oh | 215/332 |
| 7,387,214 | B1 | 6/2008 | Shingle | |
| 7,527,159 | B2 * | 5/2009 | Brozell | 215/222 |
| 7,673,763 | B1 * | 3/2010 | Oh | 215/332 |
| 7,686,194 | B2 * | 3/2010 | Kasting | 222/549 |
| 7,967,159 | B2 * | 6/2011 | Miceli et al. | 215/228 |
| 8,079,488 | B2 * | 12/2011 | Darflinger | 220/212 |
| 8,240,492 | B2 * | 8/2012 | Mileti | 215/317 |
| 8,424,695 | B2 * | 4/2013 | Buono | 215/222 |
| 2001/0035388 | A1 * | 11/2001 | Miceli et al. | 215/228 |
| 2003/0059347 | A1 | 3/2003 | Ostgaard et al. | |
| 2006/0207960 | A1 * | 9/2006 | Bastero Lopez | 215/331 |
| 2006/0273063 | A1 * | 12/2006 | Borger | 215/331 |
| 2006/0289377 | A1 * | 12/2006 | Miceli et al. | 215/332 |
| 2007/0181527 | A1 * | 8/2007 | Kaufman | 215/317 |
| 2008/0099423 | A1 * | 5/2008 | Koch | 215/230 |
| 2008/0223811 | A1 * | 9/2008 | Miceli et al. | 215/201 |
| 2009/0101616 | A1 * | 4/2009 | Brennan et al. | 215/201 |
| 2009/0152229 | A1 * | 6/2009 | Falzoni | 215/40 |
| 2011/0024420 | A1 * | 2/2011 | King | 220/254.8 |
| 2012/0037589 | A1 * | 2/2012 | King | 215/329 |

* cited by examiner

CONTAINER CAP LOCKING MECHANISM

CROSS REFERENCE TO RELATED APPLICATION

This application claims the benefit of the prior filed, provisional application Ser. No. 61/148,294, filed Jan. 29, 2009.

BACKGROUND OF THE INVENTION

1. Field of the Invention

The present invention relates to a container cap locking mechanism including features on a container cap and on an associated container body that interlock with one another when the cap is fully tightened to provide physical and visual indication that the cap is fully closed and optimally sealed to the container.

2. Description of the Related Art

Features and devices for locking container caps onto container bodies typically are hidden between the wall of the cap and/or the container neck and often comprise multiple pieces that must be assembled prior to use. Hidden cap locking features typically are used to secure the cap to the container and to prevent the container from inadvertently opening. They do not typically provide a visual indicator to alert a user when the cap has been properly secured to the container body. In particular, a threaded cap must be appropriated threaded onto an associated container body in order for the inner surface of the cap to completely seal against the top surface of the container body neck. Over-tightening can result in deformation of cap and body threads and can also cause the cap or body itself to deform, thereby breaking the seal therebetween.

What is needed, therefore, is a container cap locking mechanism that not only locks the cap onto the container when in sufficient sealed engagement, but also provides visual indication of the lock to the user.

SUMMARY OF THE INVENTION

An embodiment of a container cap locking mechanism and sealing alignment indicator may include may include the following features. A threaded cap and includes an annular flange or wall having a downward pointing barb and adjacent downward pointing stop, both at the lower edge of the flange. The container body sidewall includes an outwardly extending block having a V-notch sized to receive the barb. Upon sufficient rotation of the threaded cap onto the threaded container neck, the barb is received into the notch and rotation is halted by the stop abutting a side of the block, thus indicating that the closure has achieved maximum desired rotation and is sealed. The interlocked barb and notch also prevent the cap from loosening inadvertently, as may occur due to air pressure changes and/or vibration during shipping. The stop prevents the cap from being over-tightened as the cap is threaded upon the container body.

The locking mechanism disclosed herein aids a specimen collector by providing a physical as well as visual indication that the container lid or cap has been tightened to an optimal position for sealing the cap to the container, while avoiding and even preventing excessive torque from being applied to the cap through over tightening, thereby ensuring that the container is properly closed, sealed and ready for transport without leakage.

A further embodiment may include a container cap or closure having an integral sampling member (probe, spoon, spork, spatula, etc.). Preferably, the spoon has tines on the distal end to form a structure similar to one commonly known as a spork (combination spoon and fork). The threaded cap includes an integral stem extending from its inner surface and the spoon is on the distal end of the stem.

Other advantages of the invention will become apparent from the following description taken in connection with the accompanying drawings, wherein is set forth by way of illustration and example several embodiments of the present invention.

DETAILED DESCRIPTION

As required, a detailed embodiment of the present invention is disclosed herein; however, it is to be understood that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
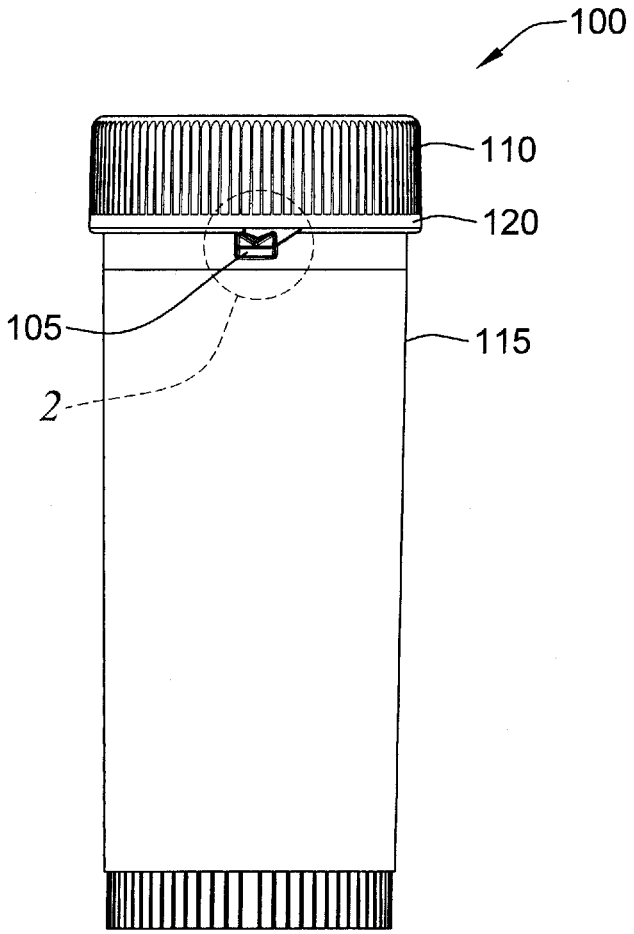
FIG. 1 is a perspective view of a container cap threadably attached to a container body and showing the locking features of the cap intermeshed with the locking features of the body.
Figure 2:
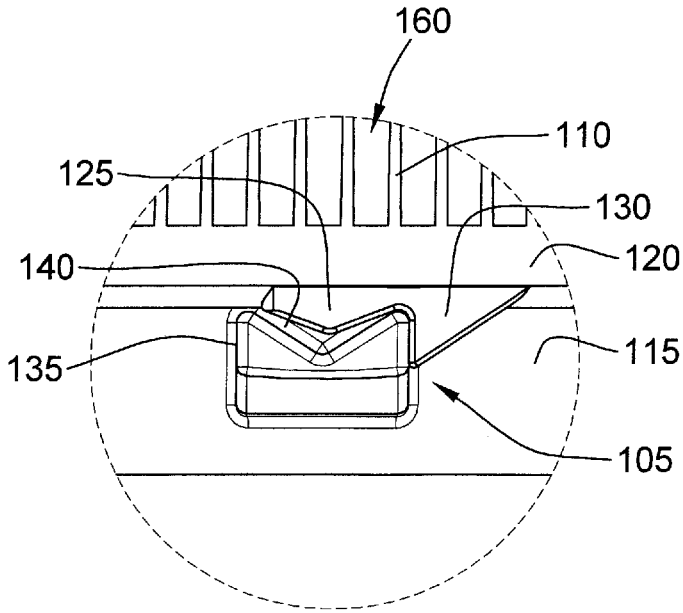
FIG. 2 is a partial, enlarged view of a container including a locking mechanism of the present invention.

Referring now to the drawings, FIGS. 1 and 2 illustrate a container 100 including an embodiment of the container cap locking mechanism 105. A container cap 110 is threadably attached to a vial or other container body 115 by tightening the cap 110 onto the body 115 until the cooperating elements of the locking mechanism on the cap 110 and on the body 115 align and lock together. The container cap locking mechanism 105 also serves as a sealing alignment indicator and may include the following features. The cap 110 is threaded and includes an annular flange 120 having a downward pointing barb 125 and adjacent downward pointing stop 130 both at the lower edge of the flange 120. The container body 115 sidewall includes an outwardly extending block 135 having a V-shaped notch 140 sized to receive the barb 125. As shown in FIGS. 1, 2, and 18-20, the barb 125 and notch 140 are substantially coplanar when engaged with one another and both exhibit a V-shape when viewed at a front elevation. Upon sufficient rotation of the threaded cap 110 onto the threads 142 of the container threaded neck 145, the barb 125 is received in the notch 140 and rotation is halted by the stop 130 abutting a side of the block 135, thus indicating that the cap 110 has achieved maximum desired rotation and is sealed against the body 115.

FIG. 1 is a perspective view of a container cap 110 fully screwed or threaded upon a container body 115 and showing the barb 125 and stop 130 of the cap 110 intermeshed or interlocked with the block 135 projecting from the body 115. FIG. 2 is a partial, enlarged view of a container 100 and associated container cap locking mechanism 105. The barb 125 is more clearly shown held within the V-notch 140 of the block 135 and the stop 130 is shown abutting the right side of the block 135 as will occur when the locking mechanism is configured for a cap 110 that is threaded clockwise (as viewed looking down upon the top of the cap 110) onto a container body 115. As shown in FIGS. 1, 2, 19 and 20, the barb 125 and notch 140 are shaped to have cooperating, complimentary, mating surfaces so that when the barb 125 is seated within the notch 140 such surfaces abut to hold the barb 125 at a fixed position within the notch 140 indicating full and optimal closure of the cap 110. As shown mostly clearly in FIGS. 2, 14 and 18-20, the barb 125 includes forward and rear sides that taper and converge to a point, thereby defining the substantial V-shape of the barb 125. More particularly, barb forward side 125*a* tapers downward and rearward to terminate at the lower margin thereof (and of the barb 125 itself) at the point 125*b*. Barb rear side 125*c* tapers downward and forward to also terminate at a lower margin thereof at the point 125*b*. The notch 140 includes a notch forward side 140*a* and a notch rear side 140*c* that are substantially parallel to complimentary, adjacent sides of the barb 125 when the barb is seated within the notch 140. The notch forward side 140*a* tapers downward and rearward to the nadir 140*b* or lowest portion of the notch 140. Notch rear side 140*c* tapers downward and forward to meet notch forward side 140*a* at nadir 140*b*, which is defined by the vertex of sides 140*a* and 140*c*. In use, as the cap 110 is tightened upon the container body 115, the point 125*b* rides or slides across the top margin 140*d* of the notch rear side 140*c* and then descends into the notch 140 until the point 125*b* rests at the nadir 140*b* (see FIGS. 18-20). When the point 125*b* is at the nadir 140*b*, the barb forward side 125*a* lies against the notch forward side 14*a*, the barb rear side 125*c* lies against the notch rear side 140*c*, and the barb 125 is fully engaged with the notch 140. Concomitantly, the stop 130 abuts the right rear edge 135*a* of the block 135 thereby halting the barb 125 from further forward movement out of the notch 140.

Figure 3:
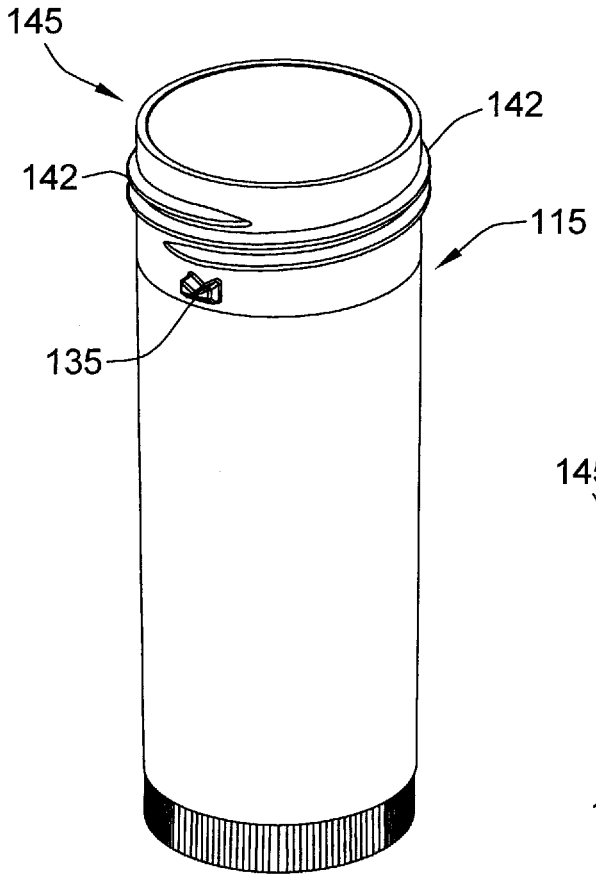
FIG. 3 is a perspective view of a container body.
Figure 4:
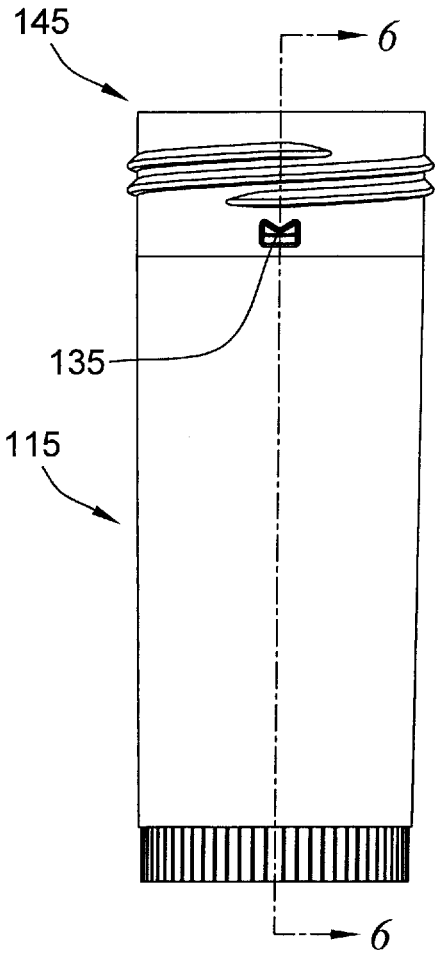
FIG. 4 is a front elevation of a container body.
Figure 5:
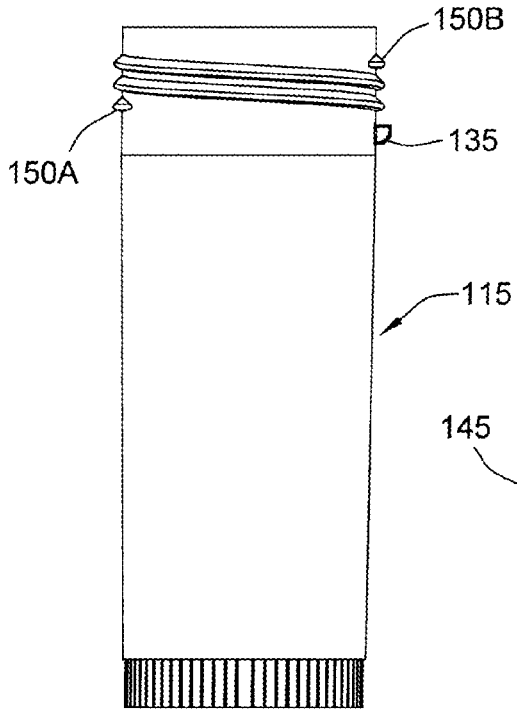
FIG. 5 is a side elevation of a container body.
Figure 6:
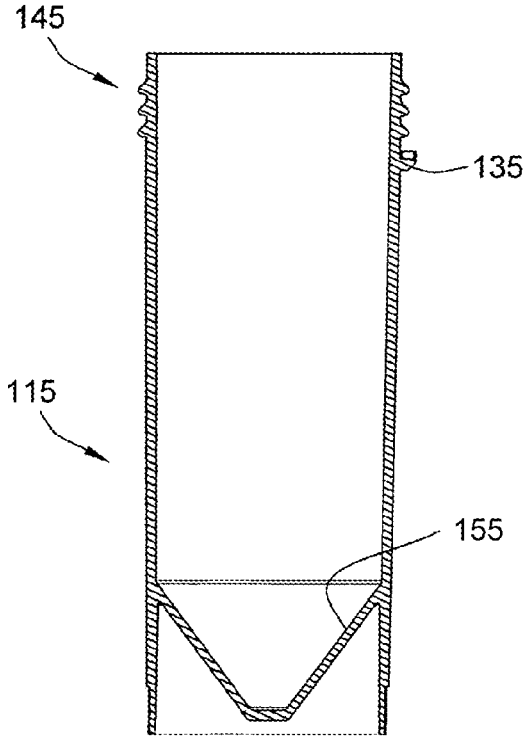
FIG. 6 is a sectional view of a container body taken along line 6-6 in FIG. 5.
Figure 9:
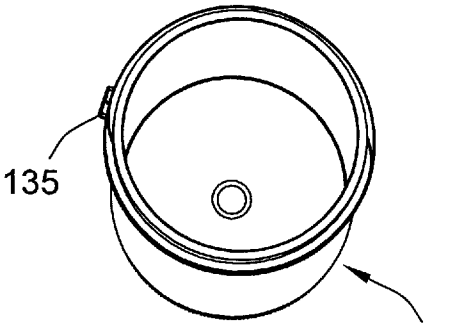
FIG. 9 is a top perspective view of a container body.
Figure 10:
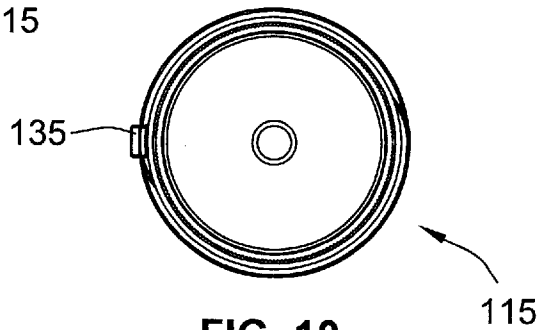
FIG. 10 is a top plan view of a container body showing the interior of the container.
Figure 8:
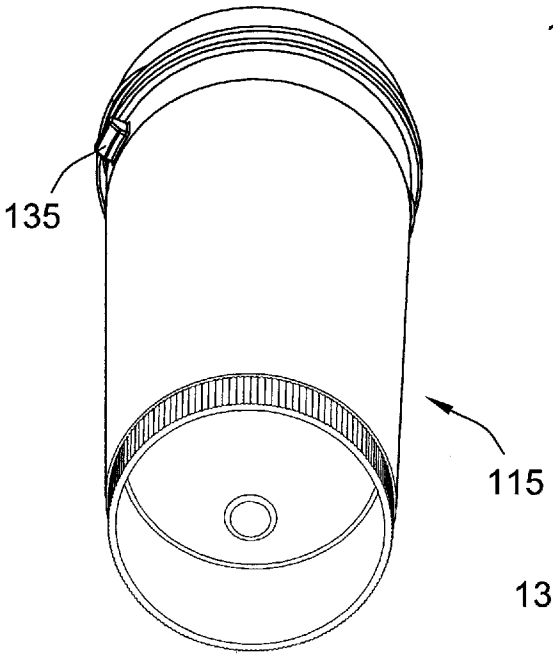
FIG. 8 is a bottom perspective view of a container body.
Figure 7:
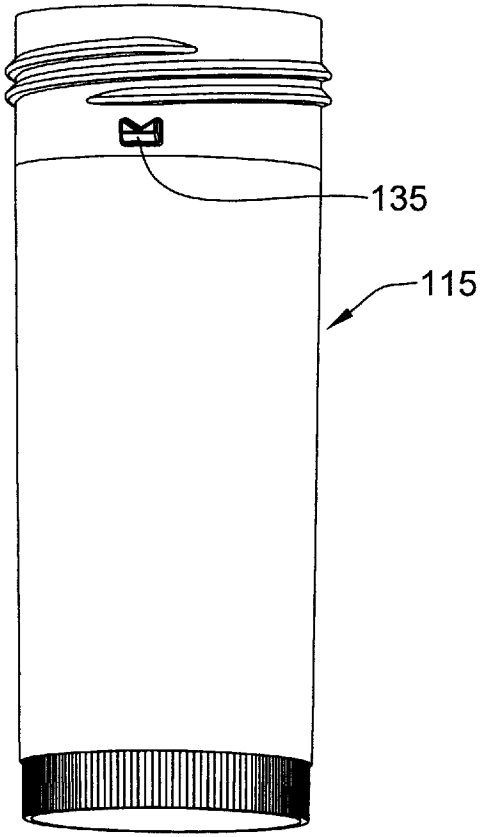
FIG. 7 is a front perspective view of a container body.
Figure 11:
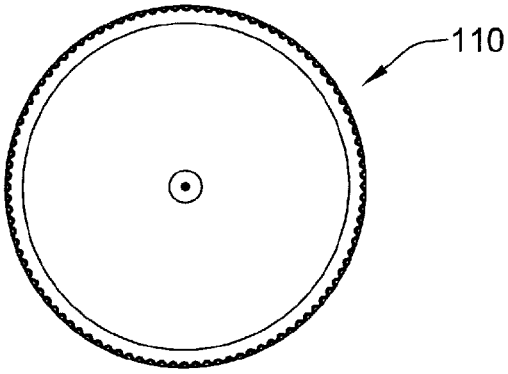
FIG. 11 is a top plan view of a container cap.
Figure 12:
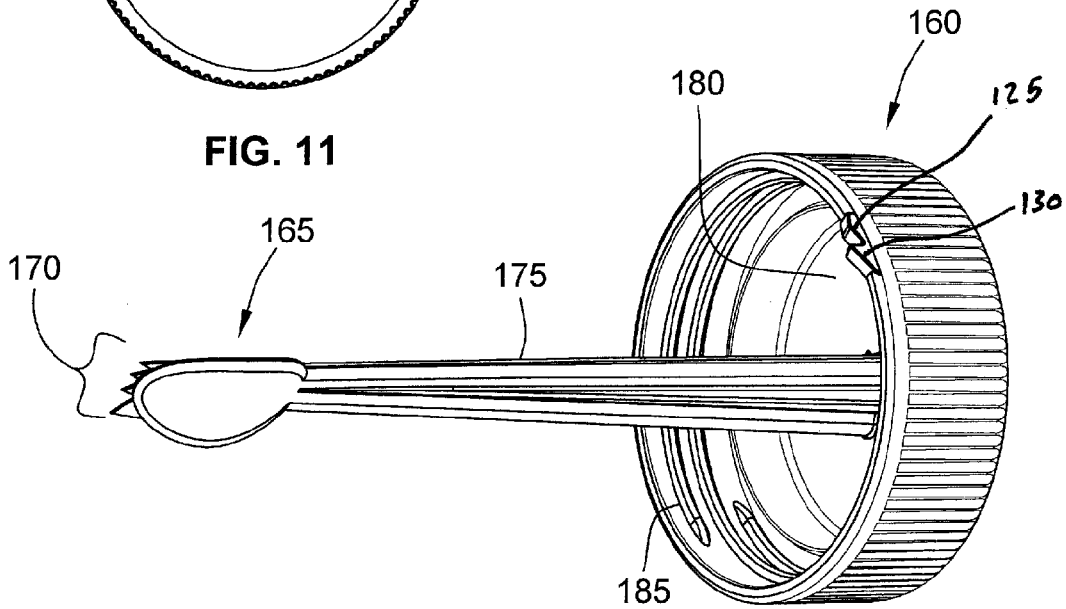
FIG. 12 is a perspective view of an alternative embodiment of a container cap including a tined spoon projecting from the bottom surface of the cap.
Figure 13:
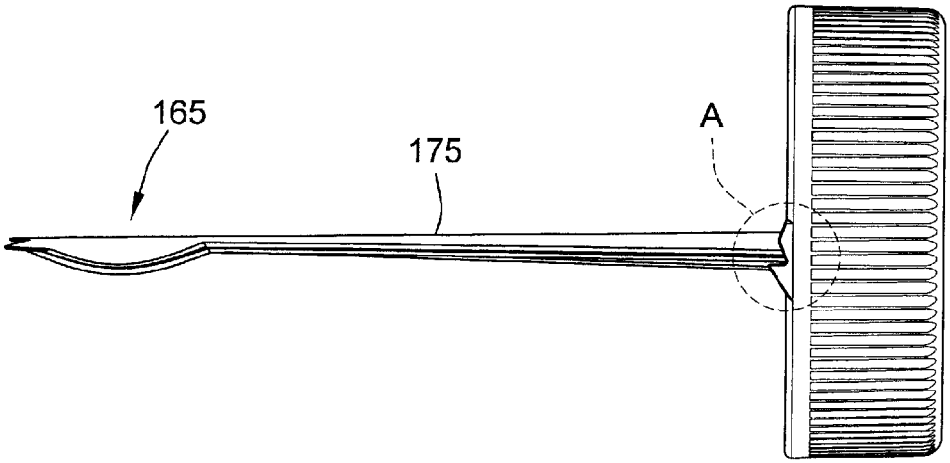
FIG. 13 is a side elevation of the cap of FIG. 12.

FIGS. 3, 4 and 5 show perspective, front elevation, and side elevation views of a container body 115, respectively. FIG. 6 shows a cross sectional view of a container body 115 or vial having a conical bottom surface 155. FIGS. 7 through 10 show various additional views of a container body 115. FIG. 11 provides a view of the top surface of a container cap 110. As shown most clearly in FIGS. 5 and 9, a container body 115 may include two or more thread starts 150A and 150B, typically no more than four. If preferred, a block 135 may be provided at each thread start to allow for more than one closure site.

A further embodiment of a container 100 may include an alternative container cap 160 or closure having an integral sampling member (probe, spoon, spork, spatula, etc.) 165. Preferably, the spoon 165 has a plurality of tines 170 projecting from the distal end of the spoon 165 to form a structure similar to one commonly known as a spork (combination spoon and fork). The threaded cap 160 includes an integral stem 175 extending from its inner surface 180 and the spoon 165 is on the distal end of the stem 175.

Figure 14:
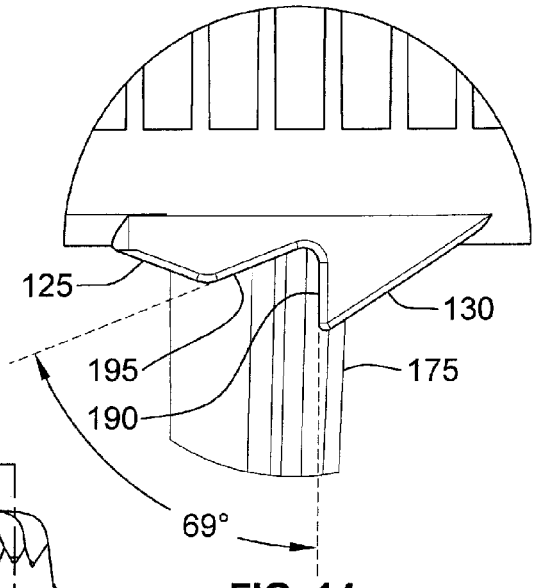
FIG. 14 is an enlarged view of the locking mechanism shown in FIG. 13.
Figure 15:
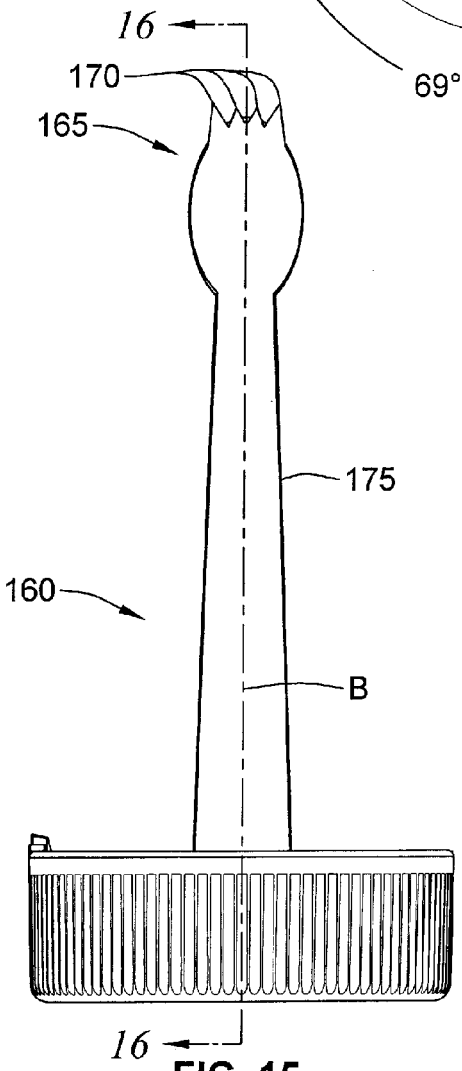
FIG. 15 is a side elevation of the cap with the spoon pointing upward and the top of the cap pointing downward.
Figure 16:
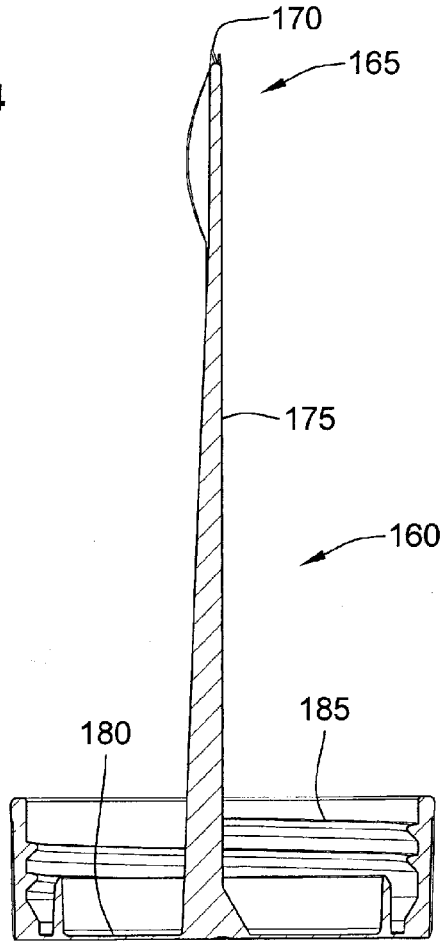
FIG. 16 is a section of the cap of FIG. 15 taken in the plane of line 16-16.
Figure 17:
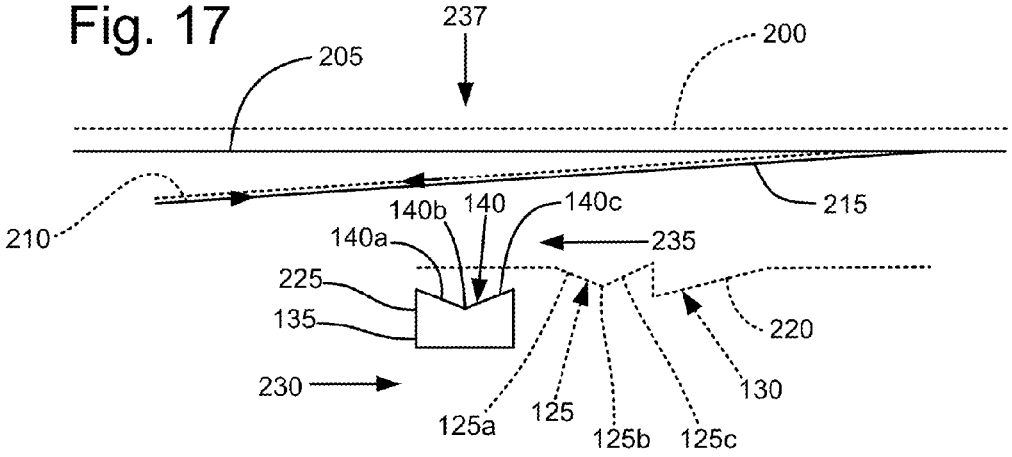
FIG. 17 is a perspective view of a cap with two barb and stop assemblies located on the annular flange in diametrical opposition to each other.

FIGS. 12, 13, 15 and 16 provide various views of the cap 160 including cap threads 185. FIG. 14 is an enlargement of a region defined by circle A in FIG. 13. The embodiment shown in FIG. 14 includes an operable angle of approximately 69° between the surface 190 of the stop 130 that abuts the block 135 and the proximate surface 195 of the barb 125. The surface 190 of the stop 130 is generally parallel to the longitudinal axis (see phantom line B in FIG. 15) of the container and cap 160.

Figure 18:
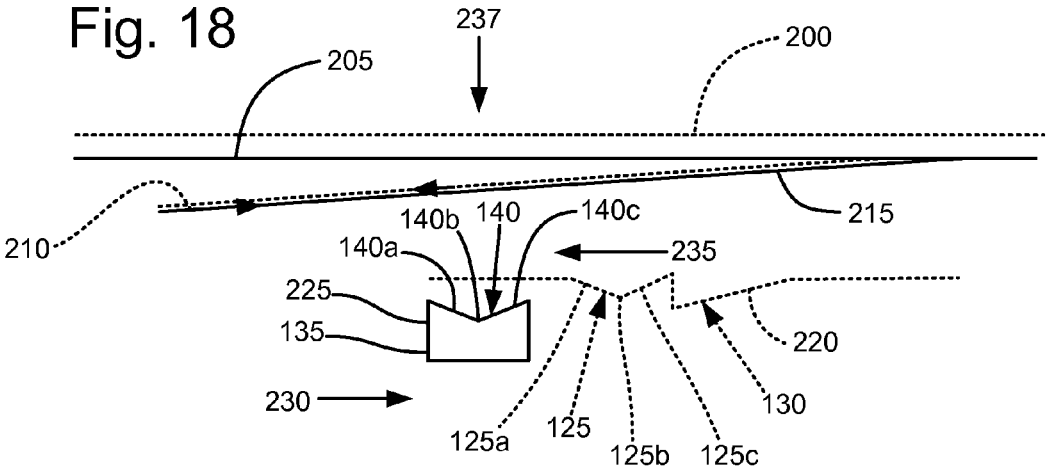
FIG. 18 is a diagram not drawn to scale illustrating the function of the locking mechanism relative to the rotation and sealing of the inner surface of a cap to the upper end of a container body.
Figure 19:
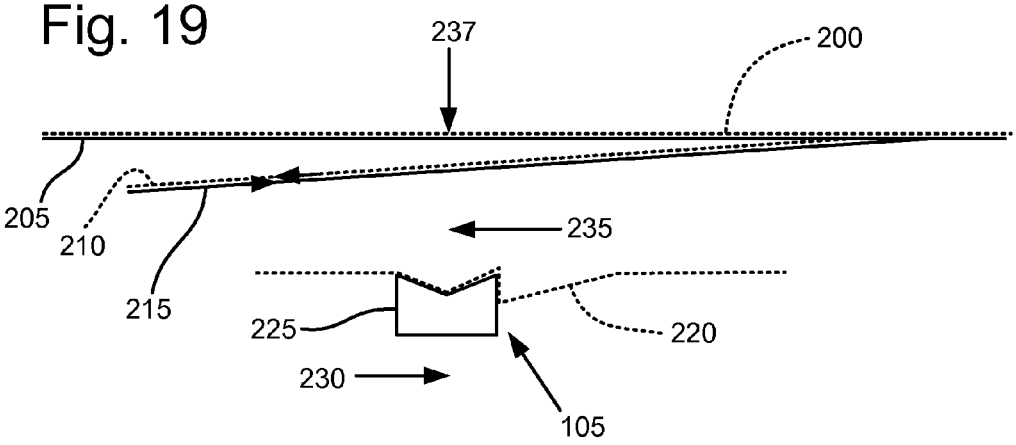
FIG. 19 is a diagram not drawn to scale illustrating the function of the locking mechanism relative to the rotation and sealing of the inner surface of a cap to the upper end of a container body.

FIGS. 18 and 19 are diagrams not drawn to scale illustrating the function of the locking mechanism 105 relative to the rotation and sealing of the inner surface of a cap 110 to the upper end of a container body 115. Phantom lines in FIGS. 18 and 19 represent structures associated with a cap 110, and solid lines represent structures associated with a container body 115. Phantom line 200 represents the inner surface of a cap 110 adapted to seal against the upper end of a container 115. Solid line 205 represents the surface of the upper end of a container body 115 adapted to seal against the inner surface of a cap 110. Phantom line 210 represents the inclined plane of a cap thread adapted to cooperatively and threadably engage a container body thread. Solid line 215 represents the inclined plane of a container body thread adapted to cooperatively and threadably engage a cap thread. Phantom line 220 represents the barb 125 and stop 130 of a cap 110 and moves in conjunction with lines 200 and 210. Solid shape 225 represents a block 135 attached to a container body 115 and moves in conjunction with lines 205 and 215. As elements 200, 210 and 220 move leftward in accord with cap rotation to tighten upon a container, elements 205, 215 and 225 may be moved rightward or may remain stationary, the effect being that such elements move relative to each other in the directions shown by arrows 230 and 235.

As illustrated through the comparison of FIGS. 18 and 19, as the cap elements move leftward and thread 210 slides downward along thread 215, the cap sealing surface 200 is drawn downward (in the direction of arrow 237) against the container sealing surface 205. Elements 200-225 are calibrated and constructed so that when sealing surfaces 200 and 205 are drawn together optimally to form a seal, barb 125 has moved leftward and downward sufficiently to fully engage with notch 140 and stop 130 abuts the right, rear edge of block 225. Block 225 therefore presents an impediment via its engagement with barb 125 and stop 130 to further leftward movement and tightening of the cap relative to the container body 115, and optimal sealed engagement of the cap 110 to the container is achieved and indicated visually via the disposition of barb 125 within notch 140.

Figure 20:
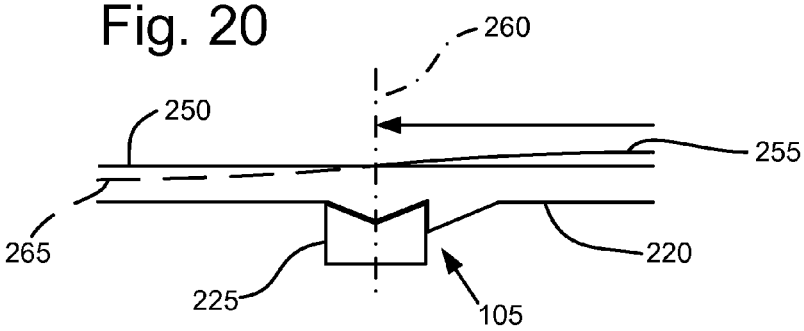
FIG. 20 is a diagram not drawn to scale illustrating the effect of the locking mechanism of the present invention on achieving and retaining an optimal cap and container seal.

FIG. 20 is a diagram not drawn to scale illustrating the effect of the novel locking mechanism of the present invention on achieving and retaining an optimal cap and container seal. Solid line 250 represents the interface between cap and container sealing surfaces when an optimal seal is achieved therebetween. Solid line 255 represents the relative degree of tightening between the cap 110 and container 115 with the space between lines 250 and 255 indicating the magnitude of the gap therebetween. Phantom line 260 intersects the point on line 255 where line 255 intersects line 250 indicating that optimal tightening of the cap 110 to the container 115 has been achieved and that this is concomitant with full engagement of the barb 125 within the notch 140. Phantom line 265 indicates that if overtightening were to occur, as might be the situation without the present locking mechanism 105 to prevent overtightening, further tightening of the cap 110 upon the container 115 may cause flexion of the cap 110 and/or container 115 structures thereby reducing the quality of the seal by creating or increasing gaps between the cap and container sealing surfaces.

A method of using a locking mechanism 105 of the present invention may include the steps of providing a threaded container body 115 with an open upper end, and providing a cooperatively threaded container cap 110 having a closed upper end and an open bottom end. The cap 110 may have a forward rotative direction of travel when rotated to tighten upon the container body 115 and a rearward rotative direction of travel when rotated to loosen and disengage from the container body 115.

The cap 110 further includes a pointed barb 125 projecting downward from the bottom end and a stop 130 positioned proximate to, and rearward of, the barb 125 and also projecting downward from the bottom end. The container body 115 includes a block 135 projecting outward from the body 115. The block 135 includes a notch 140 in an upper surface thereof, the notch 140 sized to accept and retain the barb 125. Further steps include rotatively engaging the cap 110 with the body 115 by turning the cap 110 in a forward direction to engage cooperative threads on the cap 110 and body 115 with one another, and continuing to turn the cap 110 in a forward direction until the barb 125 is positioned within the notch 140 and the stop 130 is positioned against a rearward side of the block 135, thereby halting rotation of the cap 110 relative to said body 115. Turning the cap 110 until the barb 125 is positioned within the notch 140 assures that the body 115 and the cap 110 are in sealed engagement. Turning the cap 110 until the barb 125 is positioned within the notch 140 also visually indicates that the body 115 and the cap 110 are in sealed engagement.

It is to be understood that while certain forms of this invention have been illustrated and described, it is not limited thereto except insofar as such limitations are included in the following claims and allowable equivalents thereof.

Having thus described the invention, what is claimed as new and desired to be Secured by Letters Patent is:

1. A container cap locking mechanism, said locking mechanism comprising:

a threaded cap having a closed top end and an open bottom end, an annular flange extending downwardly from said bottom end of said cap, a barb extending downwardly from said annular flange, said barb substantially having a V-shape defined by sides converging to a point, a stop extending downwardly from said annular flange proximate said barb, a threaded container body having an open top end and a closed bottom end, and a block extending outwardly from said top end of said container body, said block having a front edge and a back edge and forming a V-shaped notch for receiving said barb, said notch including V-shaped sides converging to a nadir, wherein as the bottom end of said cap is threaded onto said top end of said container body to tighten said cap relative to said container body, said barb slides over said block to be received into said notch, said V-shaped sides of said barb abutting said V-shaped sides of said notch, and said back edge of said block abuts against said stop to impede further tightening of said cap relative to said container body.

2. The container cap locking mechanism as in claim 1, wherein said threaded cap is internally threaded.

3. The container cap locking mechanism as in claim 2, wherein said threaded container body is externally threaded.

4. The container cap locking mechanism as in claim 1, said container cap further comprising:

a sampling member stem extending downwardly from the bottom surface of said closed top end of said cap, and a sampling end extending from a distal end of said sampling member stem.

5. The container cap locking mechanism as in claim 4, wherein said sampling end further comprises a plurality of tines extending from the distal end of said sampling end.

6. The container cap locking mechanism as in claim 1, said internally threaded cap including at least one starting thread.

7. The container cap locking mechanism as in claim 6, said barb provided proximate at each at least one thread start.

8. A method for identifying a sealed cap position, said method comprising the steps of:

providing a threaded container cap and a cooperatively threaded container body, said container body having an open upper end, said cap having a closed upper end an open bottom end and further having a forward rotative direction of travel when rotated to tighten upon said container body, and having a rearward rotative direction of travel when rotated to loosen and disengage from said container body, said cap including a pointed V-shaped barb projecting downward from said bottom end and a stop positioned proximate to and rearward of said barb and projecting downward from said bottom end, said container body including a block projecting outward from said body, said block including a V-shaped notch in an upper surface thereof, said notch sized to accept and retain said barb, rotatively engaging said cap with said body by turning said cap in a forward direction to engage cooperative threads on said cap and body with one another, and turning said cap in a forward direction until said barb is positioned within said notch so that the V-shaped sides of said barb are received within and abut the V-shaped sides of said notch, and said stop is positioned against a rearward side of said block, thereby halting forward rotation of said cap relative to said body.

9. The method of claim 8 whereby turning said cap until said barb is positioned within said notch assures that said body and said cap are in sealed engagement.

10. The method of claim 8 whereby turning said cap until said barb is positioned within said notch visually indicates that said body and said cap are in sealed engagement.

11. A container cap locking mechanism, said locking mechanism comprising:

a threaded cap having a closed top end and an open bottom end, an annular flange extending downwardly from said bottom end of said cap, a stop extending downwardly from said annular flange, said stop having a front surface, a barb extending downwardly from said annular flange, said barb substantially having a V-shape defined by sides converging to a point, said barb proximate to and forward of said stop in the direction of travel when said cap is rotated as to tighten upon a container body, said barb having an angled operative surface, said angled operative surface forming an acute angle with said front surface of said stop, said acute angle being between said angled operative surface and said front surface of said stop, a threaded container body having an open top end and a closed bottom end, and a block extending outwardly from said top end of said container body, said block having a front edge and a back edge that converge at a nadir to form and forming a V-shaped notch for receiving said barb, wherein as the bottom end of said cap is threaded onto said top end of said container body to tighten said cap relative to said container body, said barb is received into said notch, so that the sides of said barb lie against the sides of said notch, and said back edge of said block abuts against said stop to impede further tightening of said cap relative to said container body.

* * * * *